United States Patent [19]

Blaese

[11] Patent Number: 4,779,098

[45] Date of Patent: Oct. 18, 1988

[54] MODIFIED ON-GLASS ANTENNA WITH DECOUPLING MEMBERS

[76] Inventor: Herbert R. Blaese, 3314 Olcott Ave., Chicago, Ill. 60634

[21] Appl. No.: 6,573

[22] Filed: Jan. 22, 1987

[51] Int. Cl.[4] ..... H01Q 1/32

[52] U.S. Cl. ..... 343/715; 343/713; 343/826; 343/830

[58] Field of Search ..... 343/713, 715, 826, 830, 343/850, 853, 906, 900

[56] References Cited

U.S. PATENT DOCUMENTS

| | | | |
|---|---|---|---|
| 4,238,799 | 12/1980 | Parfitt | 343/715 |
| 4,621,243 | 11/1986 | Harada | 343/715 |
| 4,658,259 | 4/1987 | Blaese | 343/715 |

FOREIGN PATENT DOCUMENTS

| | | | |
|---|---|---|---|
| 0137391 | 4/1985 | European Pat. Off. | 343/715 |
| 8700974 | 2/1987 | Int'l Pat. Institute . | |
| 2172148 | 9/1986 | United Kingdom . | |

*Primary Examiner*—William L. Sikes
*Assistant Examiner*—Doris J. Johnson
*Attorney, Agent, or Firm*—George H. Gerstman; Charles F. Pigott, Jr.

[57] ABSTRACT

An antenna system for mounting on a glass plate with a radiator extending from one side of the glass plate and with an electrical connector and a cable extending from the opposite side of the glass plate whereby energy is transferred through the glass plate. Coupling means for a cable is provided, defining a receptacle for retaining the coupled end of the coaxial cable at an angle of essentially 15 to 60 degrees to said glass plate in said mounted position. Also, the antenna may define a helical base portion which may be attached to the glass plate on the side opposite to the coupling means. The helical base serves to shorten the antenna, and also to simultaneously serve as an electrical phase cancelling coil. Additionally, improvements are disclosed in the design of field cancelling conductors used.

6 Claims, 1 Drawing Sheet

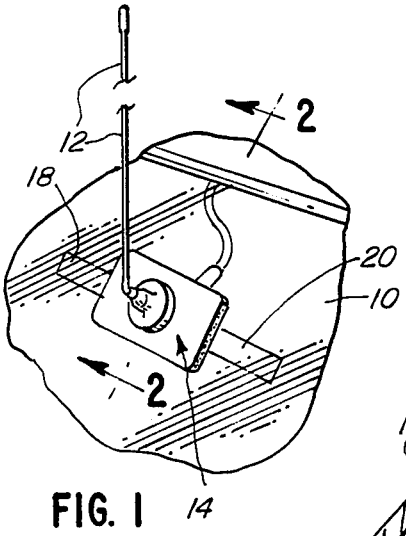
FIG. 1
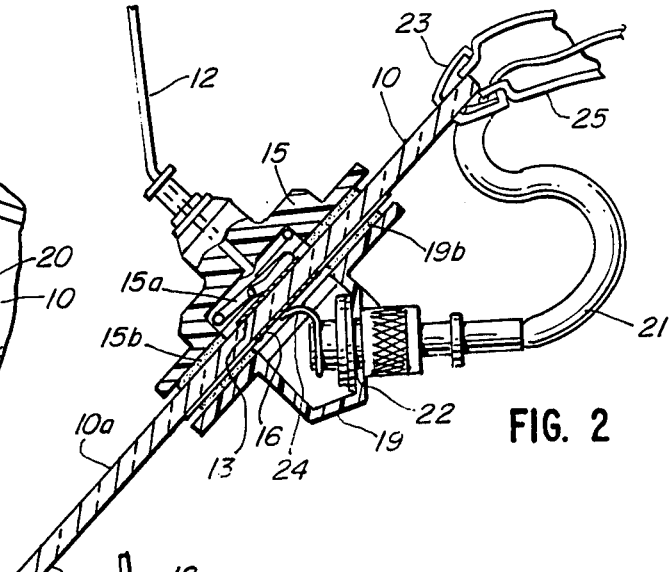
FIG. 2
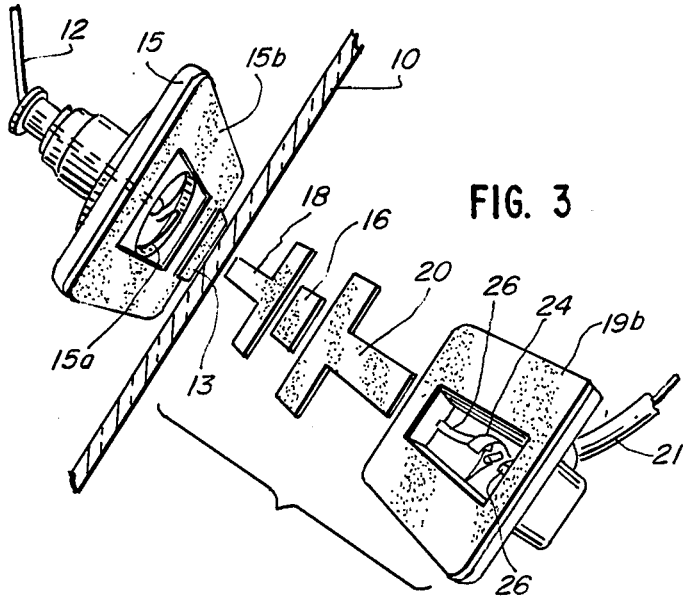
FIG. 3
FIG. 4
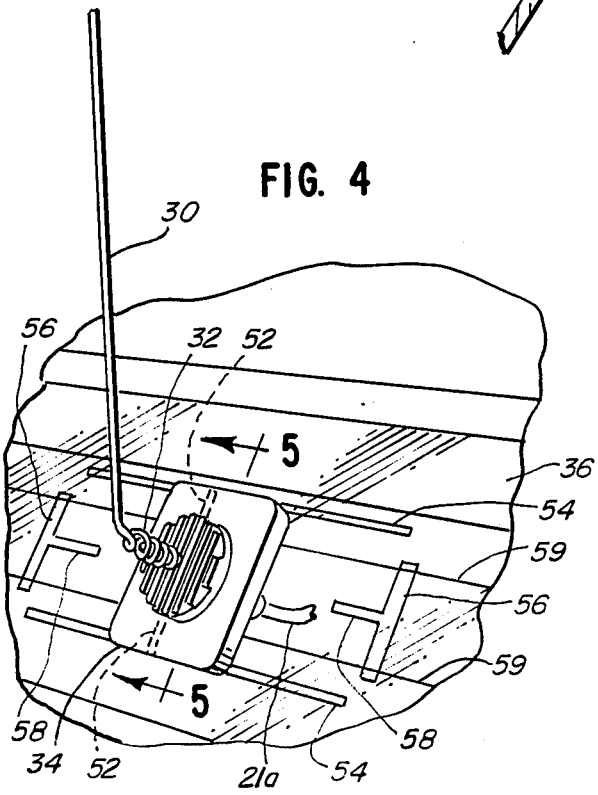
FIG. 5
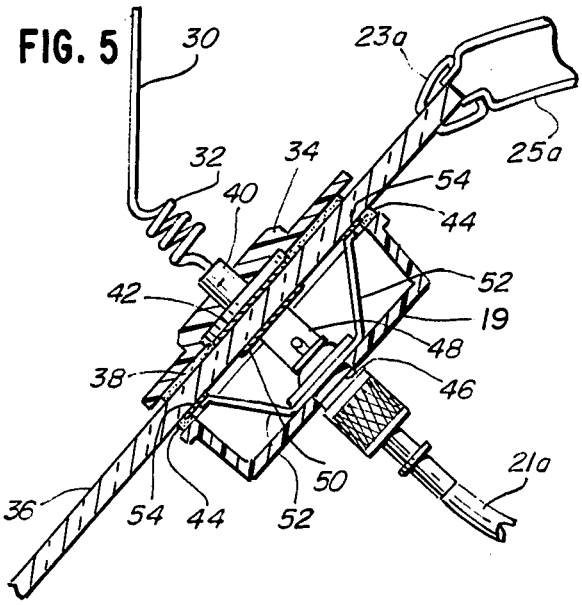

MODIFIED ON-GLASS ANTENNA WITH DECOUPLING MEMBERS

BACKGROUND OF THE INVENTION

In U.S. application Ser. No. 708,667, filed Mar. 6, 1985, now U.S. Pat. No. 4,658,259, an antenna for mounting on a glass plate is provided in which no hole needs to be drilled through the glass plate, and in which the effects of rain, snow, dirt, and salt on the glass surface are minimized, as compared with the antenna design of U.S. Pat. No. 4,238,799. Antennas manufactured in accordance with the teachings of application Ser. No. 708,667 have found good commercial acceptance for use in cellular telephone systems for automobiles and the like. However, there is need for an antenna for use at longer wave lengths, which, nevertheless, remains conveniently small so as not to be bulky and cumbersome, and which exhibits efficient operation and has a low cost of manufacture due to efficient disposition and economy of parts. Furthermore, there is a need for the antenna system to take up less space on the inside of the window, as well as the outside, with the coaxial cable being less prominent, so as not to be unsightly and to interfere with head room in a vehicle.

DESCRIPTION OF THE INVENTION

In accordance with this invention, an antenna is provided for mounting on a glass plate. The antenna has a radiator extending from one side of the glass plate and an electrical conductor carrying a coaxial cable extending from the opposite side of the glass plate, whereby energy is transferred through the glass plate.

In accordance with this invention, a current fed radiator is provided, with means for connecting the radiator to one side of the glass plate. Typically, the radiator comprises a whip antenna projecting outwardly. An electrically conductive inner energy transfer member is provided, along with means for connecting it to the other side of the glass plate in alignment with the radiator. In this case also, the connecting means may be an adhesive area on the inner transfer member.

Field-cancelling conductor means are provided for connection to said other side of the glass plate, with typically at least a pair of field-cancelling conductors being electrically spaced from the inner transfer member in the plane of the current fed radiator.

Means are then provided for coupling the central conductor of a coaxial cable to the inner transfer member, and for also coupling the ground conductor of the coaxial cable to the field-cancelling conductors.

Additionally, by this invention, the coupling means defines a receptable for retaining the coupled end of coaxial cable at an angle of essentially 15 to 60 degrees to the glass plate in mounted position. Accordingly, the coaxial cable, which connects for example to a telephone system within a vehicle, defines a less projecting loop away from the window as it first extends outwardly and then curves back again to enter the ceiling of a vehicle, for example, at an area in the vicinity of the window frame. This, in turn, provides a less unsightly display of projecting coaxial cable, and also provides more headroom in the back seat of a vehicle, for example.

It is generally preferred for the receptacle to retain the coupled end of the coaxial cable at an angle of about 45 degrees.

The current fed radiator is connected to an outer RF transfer member which carries the typically adhesive means for connecting the radiator to one side of the glass plate.

The antenna system of this invention does not require a resonant circuit interposed between the electrical wiring of the coaxial cable and the inner transfer member. The field cancelling means of course must extend in a direction that is significantly different from the direction of extension of the current fed radiator for the antenna. As a further advantage, the field cancelling members may be substantially non-volume containing portions, i.e., they may be metalized tape members, being generally balanced in shape and distribution on opposed sides of the inner transfer member.

The field cancelling member is operative to cancel the electromagnetive field in the plane of the field cancelling member.

The antenna system of this application may operate at various RF frequencies, and it is capable of operating at frequencies such as UHF (on the order of 450 megahertz) or VHF (on the order of 150 megahertz). Also, there is no inherent limitation on the frequencies used in the antenna systems of this invention, subject to appropriate and well-known design criteria. For example, the antenna system may be used at 900 megahertz with proper sizing and design.

Additionally, antennas as described above, particularly antennas for use in longer wave length radiation, may use a radiator having a helical base portion. This helical base of the radiator serves to shorten the antenna, and also to serve as an integral, electrical phase cancelling coil, so that the one part serves two functions for improved efficiency of manufacture and operation.

For example, the above radiator having a helical base may serve as a $\frac{5}{8}$ wave antenna due to the phase cancelling effect of the helical base, although the antenna would otherwise be a $\frac{3}{4}$ wave antenna.

Additionally, antennas of this invention, and particularly the antenna described immediately above, may utilize electrically conductive field cancelling conductor means comprising a substantially rectangular array of conductors on the glass plate surrounding said antenna, but naturally out of the plane of the antenna and outer transfer member to which it is attached. Preferably, separate conductors define separate sides of the rectangular array. It is also preferable for a first set of opposed sides of the rectangular array which are more distant from the antenna than a second set of the opposed sides to be each electrically connected to an electrically conducting strip that extends toward said antenna, but in the plane of the inner transfer member, which carries the coaxial cable as described above.

Accordingly, antenna systems in accordance with this invention can exhibit improvements both on the outside of the glass pane which carries them, and the inside as well. On the outside, the helical base can be used to adapt the antenna in simplified manner to longer wavelengths with less increase in antenna length. On the inside, novel improvements in the arrangement of field cancelling conductors is provided, while also the prominence of the coaxial cable as it extends from the inner transfer member can be reduced.

DESCRIPTION OF THE DRAWINGS

In the drawings, FIG. 1 is a perspective view of the back window of a vehicle, carrying one embodiment of the antenna system of this invention.

FIG. 2 is a sectional view taken along line 2—2 of FIG. 1.

FIG. 3 is an exploded perspective view of the antenna system of FIG. 1.

FIG. 4 is a perspective view of the rear view of a vehicle showing another embodiment of the antenna system of this invention.

FIG. 5 is a sectional view taken along line 5—5 of FIG. 4.

DESCRIPTION OF SPECIFIC EMBODIMENTS

Referring to FIG. 1–3, a first design of antenna system of this invention is shown. Such an antenna system may operate at a frequency of 420–520 MHz, have a gain of 3 db, a nominal impedence of 50 ohms, a maximum power of 200 watts, and a band width (1.5:1) of 20 MHz. To achieve this a radiator length of 46 cm. may be used with the antenna being connected to RG 58U coaxial cable.

Alternatively, the antenna may have a frequency of 140–174 MHz, a nominal impedence of 50 ohms, a maximum power of 150 watts, and a band width (1.5:1) of 10 MHz. In this case, the radiator may be 50.8 cm. long and used, as before, with RG 58 U coaxial cable.

As shown in FIGS. 1–3, glass plate window 10 of a vehicle is illustrated, preferably the rear window, with radiator 12 being positioned on the exterior surface 10*a* of window 10. Radiator 12 may be a quarter wavelength radiator, or any other appropriate multiple of the wavelength in use.

Radiator 12 is mounted on an outer housing which comprises a plastic, weather resistant carrier 15 having an electrically conductive coiled spring 15*a* in electrical connection with radiator 12. Housing 15 is affixed to the outer surface 10*a* of the glass window by suitable adhesive 15*b*, such as a pressure-sensitive adhesive which is supplied at the factory and is covered with tear-off paper strips. Adhesive 15*b* surrounds the periphery of carrier 15, leaving a central aperture containing spring 15*a* open. A piece of adhesive tape 13 having a conductive metal outer surface is provided, with spring 15*a* bearing against it to serve as an electrically conductive outer transfer plate.

The remaining portions of the antenna assembly are located on the inside of the vehicle, i e., on the opposite surface 10*b* of window 10. Such elements include electrically conductive inner transfer plate 16, which is formed of metal tape like member 13, having a pressure-sensitive adhesive surface which enables it to be affixed to surface 10*b* of glass plate 10. It is preferred that inner transfer plate 16 have the same dimension as outer transfer plate 13, so that the transfer plates 13 and 16 be aligned with each other so as to align inner transfer plate 16 with radiator 12.

A pair of field cancelling electrical conductive members 18, 20 are also provided. These members 18, 20 also may comprise electrically conductive metal adhesive tapes, each preferably being equal in size and spaced from each other as well as interior transfer plate 16, and are positioned on opposite sides of interior plate 16. Members 18, 20 are affixed to the glass by their adhesive surfaces in the same manner as members 13 and 16. The field-cancelling conductors 18, 20 are In a horizontal plane, and operate to cancel each other out to prevent radiation in that horizontal plane. As a result, radiation is consistent in the vertical plane only. Members 18, 20 may be sized in a manner appropriate for the electronics of the system. Although no limitation is intended, each of members of 18, 20 may have a dimension of $\frac{1}{4}$ by $3\frac{1}{2}$ inches.

Alternatively, the field-cancelling electrical conductive members, 18, 20 may comprise conductive wires or fingers which extend outwardly, rather than tape. As another alternative, members 18, 20 may be wires attached on the Inside of the car at a location adjacent the window but not on the window.

Inner electrical connector 19 may be a plastic member which is adhered to the interior of window 10*b* by a peripheral zone of contact adhesive 19*b*, in a manner similar to outer carrier 15. As shown in FIG. 2, coaxial cable 21 may be a conventional 50 ohm line having a central main conductor and a surrounding ground conductor, as is conventional. RF coaxial cable female receptacle 22 is carried by electrical connector 19 to position the outer end of cable 21 at an angle of approximately 45 degrees to the plane of glass pane 10. Thus, as coaxial cable 21 loops around to frame 23 which retains glass 10 to fit inside of the upholstery 25 at the ceiling of the vehicle, the size and extent of loop, as shown, can be substantially lessened with the necessary loop of a coaxial cable having an end which extends at an angle of about 45 degrees to glass pane 10. This, in turn, reduces the size of the unsightly loop and increases head room adjacent glass pane 10.

Electrically conductive metal finger 24 communicates between the central main conductor of cable 21 and inner transfer plate 16. Electrical connection may take place between surrounding ground conductors of cable 21 and field cancelling tapes 18, 20 by side prongs 26 (FIG. 3).

Referring to FIGS. 4 and 5, a different embodiment of the antenna system of this invention is disclosed. Such an antenna is useful at frequencies, for example, of 825–895 MHz, with a gain of 3 db, a nominal impedence of 50 ohms, a maximum power of 200 watts, and a bandwidth of 70 MHz. However, this is merely one example of performance parameters which may be accomplished by an antenna system of this design, it being contemplated that the system may operate at other frequencies and performance parameters as may be designed by those skilled in the art.

Radiator 30 may have a helical base 32, which may be a coiled part of the conductive rod which defines radiator 30. Helical base 32 may be angled with respect to the remainder of radiator 30 so that helical base 32 stands perpendicularly to the plane of window 36 and carrier 34, while the remainder of radiator 30 extends generally vertically to the ground. An angle of 10 to 80 degrees between base 32 and the remainder of radiator 30 is preferably used.

Helical base 32 is attached in conventional manner to plastic carrier or housing 34 which may adhere to the outside of window 36 by a peripheral band of adhesive 38, as in the previous embodiment. Adaptor 40 holds antenna 30 in electical contact with conductive outer transfer member 19, which is similar in structure and function to outer transfer member 13 of the previous embodiment, being, for example, a piece of metal foil adhesively attached to window 36

On the inside of window 36, housing 42 is attached by a peripheral band of adhesive 44 to the inside of the window in a manner similar to housing 19 Housing 42 also defines a receptacle for retaining and receiving the end of coaxial cable 21*a*, which is similar in structure and function to cable 21 of the previous embodiment. Prong 48 is in electrical connection with the central conductor of cable 21*a*, and communicates with inner transfer member 50, which is similar in structure and function to inner transfer member 16 of the previous embodiment.

A pair of opposed side prongs 52 are then provided for communication with an opposed pair of field cancelling tape members 54, which may be metallized tape strips as shown having an adhesive layer for adhesion to the inner surface of glass pane 36.

As a modification of this embodiment, the field cancelling conductor strips may comprise a substantially rectangular array of conductors as specifically shown in FIG. 4. Added opposed conductor strips 56 are provided to cooperate with conductor strips 54 to form the substantially rectangular array. However, the separate conductor strips 54, 56 define separated sides from each other in the rectangular array as shown. Strips 56 may also be made of metalized tape having an adhesive side for adhesion to the inner surface of glass pane 36 so as to be out of the plane of antenna 30 and its connected electrical parts on the outer surface of window 36.

Additionally, strips 56, which are shown to be more distant from antenna 30 than strips 54 at their respective closest points, are each electrically connected to an electrically conductive strip 58 that extends toward antenna 3, so that unitary strips 56, 58 are of T-shape, as shown. Significant advantages are obtained from the use of field cancelling strips (or wires as an equivalent) in this configuration.

Side prongs 52 communicate, in a manner analogous to the previous embodiment, with the ground conductor of cable 21*a* which conventionally surrounds the central main conductor of such a cable.

As a result of the above improvements, the antenna system of this invention is capable of withstanding the buffeting of an automated car wash because of the presence of helical base portion 32. Additionally, the antenna is shortened by the presence of helical base portion 32, so that, for example, a $\frac{3}{4}$ wave fed antenna is turned into a $\frac{5}{8}$ wave antenna by the presence of coil 32. Additionally, coil 32 serves as an electrical phase cancelling coil, eliminating the need for separate components for performing this function.

Strips 56, 58 provide the added benefit of electronic decoupling from heater wires 59 that may be present in window 36.

Window 36 may be conventionally mounted in frame 23*a*, which is conventionally carried by upholstered roof 25*a* in a manner similar to that of the previous embodiment. Cable 21*a* may be looped around as in the previous embodiment to extend into the upholstered roof, out of sight of the user. If desired, an angled receptacle of the type illustrated by receptacle 22 of the first embodiment may be used with respect to the embodiment of FIGS. 4 and 5, to obtain the benefits of that structure along with the benefits of the latter embodiment.

The above has been offered for illustrative purposes only, and is not intended to limit the scope of the invention of this application, which is as defined in the claims below.

That which is claimed is:

1. A current fed antenna system for mounting on a motor vehicle's glass plate with a current fed radiator extending from a first side of the glass plate and with an electrical connector and a coaxial cable extending from a second, opposite side of the glass plate whereby energy is transferred through the glass plate and the drilling of a hole for connecting the radiator to the electrical connector is unnecessary, said glass plate carrying parallel heating wires, an electrically conductive inner transfer member for connection to said second side of the glass plate in alignment with said radiator, an electrically conductive field-cancelling conductor on said second side of the glass plate, said field-cancelling conductor being electrically spaced from said inner transfer member and in a plane different from the plane of said current fed radiator, and means for coupling the central conductor of coaxial cable to said inner transfer member while coupling the ground conductor of coaxial cable to said field-cancelling conductor, the improvement comprising, in combination:

a first decoupling member carried on said second side of the glass plate and one end side of said inner transfer member, a second decoupling member located on said second side of the glass plate and positioned on the opposite side of the inner transfer member, each of said decoupling members being formed of electrically conductive material and having a first portion which extends toward said inner transfer member and a second portion that extends in a different direction from said first portion with said second portion being electrically coupled with at least one of said heater wires.

2. In an antenna as described in claim 1, in which each of said decoupling members has a generally T-shape with the top of the T comprising said second portion and being electrically coupled with at least one heater wire and with the base of the T comprising said first portion and extending toward said inner transfer member.

3. In an antenna as described in claim 1, in which said field-cancelling conductor comprises a first conductor that extends generally parallel to said heater wires and is not in contact with any of said heater wires and a second conductor member on the opposite side of the transfer member from said first conductor member and extending generally parallel to said heater wire and not in contact with the heater wire.

4. In an antenna as described in claim 1, in which said radiator has a helical coil at its base to shorten the current fed antenna electrically from $\frac{3}{4}$ wavelength to $\frac{5}{8}$ wavelength and to enhance the flexible of the radiator.

5. An antenna system for mounting on a motor vehicle's glass plate with a radiator extending from a first side of the glass plate and with an electrical connector on a second, opposite side of the glass plate, with a drilling of a hole for connecting the radiator to the electrical connector being unnecessary, said glass plate carrying parallel heating wires, the improvement comprising, in combination:

a first decoupling member carried on said second side of the glass plate and on one side of said electrical connector, a second decoupling member located on said second side of the glass plate and positioned on the opposite side of the electrical connector, each of the decoupling members being formed of electrically conductive material and having a first portion which extends toward said electrical connector and a second portion that extends in a different direction from said first portion with said second portion being electrically coupled with at least one of said heater wires.

6. In an antenna as described in claim 5, in which each of said decoupling members has a generally T-shape with the top of the T comprising said second portion and being electrically coupled with at least one heater wire and with the base of the T comprising said first portion and extending toward said electrical connector.

* * * * *